US007517024B2

(12) United States Patent
Cvek

(10) Patent No.: US 7,517,024 B2
(45) Date of Patent: Apr. 14, 2009

(54) POST-ASSEMBLY TENSION ADJUSTMENT IN ELASTOMERIC MATERIAL APPLICATIONS

(76) Inventor: Sava Cvek, 40 Woodland Rd., Jamaica Plain, MA (US) 02130

( * ) Notice: Subject to any disclaimer, the term of this patent is extended or adjusted under 35 U.S.C. 154(b) by 0 days.

(21) Appl. No.: 11/671,436

(22) Filed: Feb. 5, 2007

(65) Prior Publication Data

US 2007/0267905 A1 Nov. 22, 2007

Related U.S. Application Data

(60) Provisional application No. 60/765,118, filed on Feb. 3, 2006.

(51) Int. Cl.
*A47C 31/02* (2006.01)
*A47C 7/14* (2006.01)
*A47C 7/46* (2006.01)

(52) U.S. Cl. ..... 297/452.13; 297/452.56; 297/218.1; 297/218.3; 297/218.5; 297/284.2; 297/284.4; 297/284.6

(58) Field of Classification Search ..... 297/218.1, 297/218.3, 218.5, 284.2, 452.13, 452.56, 297/284.4, 284.6, 284.8
See application file for complete search history.

(56) References Cited

U.S. PATENT DOCUMENTS 3,178,221 A * 4/1965 Schwarz ..... 297/284.1
3,208,794 A * 9/1965 Gunn ..... 297/284.2 X
3,258,259 A * 6/1966 Bohlin ..... 297/284.4 X
3,289,220 A * 12/1966 Grimshaw ..... 297/452.56 X
4,295,681 A * 10/1981 Gregory ..... 297/284.4
4,350,388 A * 9/1982 Weiner ..... 297/284.4 X
4,465,317 A * 8/1984 Schwarz ..... 297/284.4
4,678,230 A * 7/1987 Winkle ..... 297/284.4
4,712,834 A * 12/1987 Warrick ..... 297/284.2
4,810,033 A * 3/1989 Kemmann ..... 297/284.4
5,076,643 A * 12/1991 Colasanti et al. ..... 297/284.6 X
5,137,329 A * 8/1992 Neale ..... 297/284.6
5,152,579 A * 10/1992 Bishai ..... 297/284.6
5,190,348 A * 3/1993 Colasanti ..... 297/284.6
5,314,235 A * 5/1994 Johnson ..... 297/284.6 X
5,462,335 A 10/1995 Seyler
5,529,377 A * 6/1996 Miller ..... 297/284.6
5,637,076 A * 6/1997 Hazard et al. ..... 297/284.6 X (Continued)

FOREIGN PATENT DOCUMENTS

FR 2587201 A1 * 3/1987 ..... 297/284.2

(Continued)

*Primary Examiner*—Rodney B. White
(74) *Attorney, Agent, or Firm*—O'Connell Law Firm

(57) ABSTRACT

An arrangement for enabling post-assembly tension adjustment in an elastomeric material application. The arrangement can have a frame structure and a panel of elastomeric material, such as elastomeric mesh, retained to span from a first side to a second side of the frame structure in tension. A tension adjustment assembly enables a post-assembly, selective deflection of the panel of elastomeric material and thus the tension in the panel of elastomeric material. The tension adjustment assembly can, for example, employ a selectively inflatable bladder, an extension and retraction arrangement with a biasing portion, a pivoting member, a laterally slidable member, a roller with a non-concentric pivot axis a deflection member with a tip portion disposed to an outer surface side of the panel of elastomeric material, or a deflection member slidable on an inclined surface in relation to the panel of elastomeric material.

23 Claims, 9 Drawing Sheets

U.S. PATENT DOCUMENTS

| | | | | | |
|---|---|---|---|---|---|
| 5,772,281 | A * | 6/1998 | Massara | 297/284.4 |
| 5,785,669 | A * | 7/1998 | Proctor et al. | 297/284.6 |
| 5,806,928 | A * | 9/1998 | Gattuso et al. | 297/284.6 |
| 5,826,937 | A * | 10/1998 | Massara | 297/284.6 |
| 5,860,699 | A * | 1/1999 | Weeks | 297/284.6 |
| 5,868,466 | A | 2/1999 | Massara et al. | |
| 6,203,105 | B1 | 3/2001 | Rhodes, Jr. | |
| 6,220,663 | B1 * | 4/2001 | Benden et al. | 297/284.6 |
| 6,290,295 | B1 * | 9/2001 | Benden et al. | 297/284.6 |
| 6,354,662 | B1 * | 3/2002 | Su | 297/284.4 X |
| 6,588,842 | B2 * | 7/2003 | Stumpf et al. | 297/284.4 |
| 6,814,408 | B2 * | 11/2004 | Chen | 297/284.6 |
| 7,008,021 | B2 * | 3/2006 | Schultz et al. | 297/452.56 |
| 7,249,802 | B2 * | 7/2007 | Schmitz et al. | 297/284.4 X |
| 7,347,495 | B2 * | 3/2008 | Beyer et al. | 297/284.4 X |
| 7,396,077 | B2 * | 7/2008 | Boulva | 297/284.2 |
| 7,419,222 | B2 * | 9/2008 | Schmitz et al. | 297/284.4 X |
| 2004/0174056 | A1 * | 9/2004 | Gryp et al. | 297/284.6 |
| 2005/0062323 | A1 * | 3/2005 | Dicks | 297/284.4 |
| 2005/0242652 | A1 | 11/2005 | Kepler et al. | |
| 2006/0131938 | A1 * | 6/2006 | Moriggi | 297/284.4 |
| 2006/0138832 | A1 * | 6/2006 | Ogura | 297/284.4 |
| 2006/0244293 | A1 * | 11/2006 | Buffa | 297/284.4 |

FOREIGN PATENT DOCUMENTS

| | | | | |
|---|---|---|---|---|
| GB | 2035792 A * | 6/1980 | | 297/284.2 |

* cited by examiner

POST-ASSEMBLY TENSION ADJUSTMENT IN ELASTOMERIC MATERIAL APPLICATIONS

FIELD OF THE INVENTION

This invention relates generally to elastomeric material applications. More particularly, disclosed and protected herein are tension adjustment assemblies for enabling a post-assembly adjustment of tension in elastomeric material applications.

BACKGROUND OF THE INVENTION

Elastomeric materials have been employed in numerous applications, including in providing support surfaces in furniture. For example, panels of elastomeric material have been retained by various arrangements relative to frames to act as seating and back support surfaces in chairs. In many applications, a pre-tensioning of the elastomeric material has been employed to facilitate the support characteristics of the occupant.

Providing varied support characteristics relative to different areas of such articles can be desirable. As such, the present inventor has recognized that a variable pattern of pre-tensioning of the elastomeric material can provide varying levels of support and resistance to deflection in different portions of a structure. For example, variable pre-tensioning can be employed to provide enhanced support to a seat occupant's lumbar or posterior regions while providing added flexibility relative to other portions of an occupant's body.

While variable pre-tensioning is advantageous for these and further reasons, it is now recognized by the present inventor that enabling post-assembly tension adjustment in elastomeric material applications would be uniquely advantageous for a plurality of reasons including, for example, enabling various occupants to adjust tensioning in a given article of furniture to accommodate their unique needs and comfort characteristics, to accommodate any plastic deformation in materials, and for still further reasons.

SUMMARY OF THE INVENTION

With a recognition of the need and desirability for enabling post-assembly tension adjustment in elastomeric material applications, the present inventor discloses herein a plurality of examples of the many mechanisms that could be employed within the scope of the present invention for accomplishing that post-assembly tension adjustment.

Numerous objects and advantages of the present invention will become obvious not only to one who reviews the present specification and drawings but also to those who experience an embodiment of the present invention in operation. However, it will be appreciated that, although the accomplishment of each of multiple objects in a single embodiment of the invention may be possible and indeed preferred, not all embodiments will seek or need to accomplish each and every potential advantage. Nonetheless, all such embodiments should be considered within the scope of the present invention.

DETAILED DESCRIPTION OF PREFERRED EMBODIMENTS

As is the case with many inventions, the present invention for post-assembly tension adjustment in elastomeric material applications is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction and illustrations of inventive concepts are mere examples of the many possible manifestations of the invention.

Figure 1:
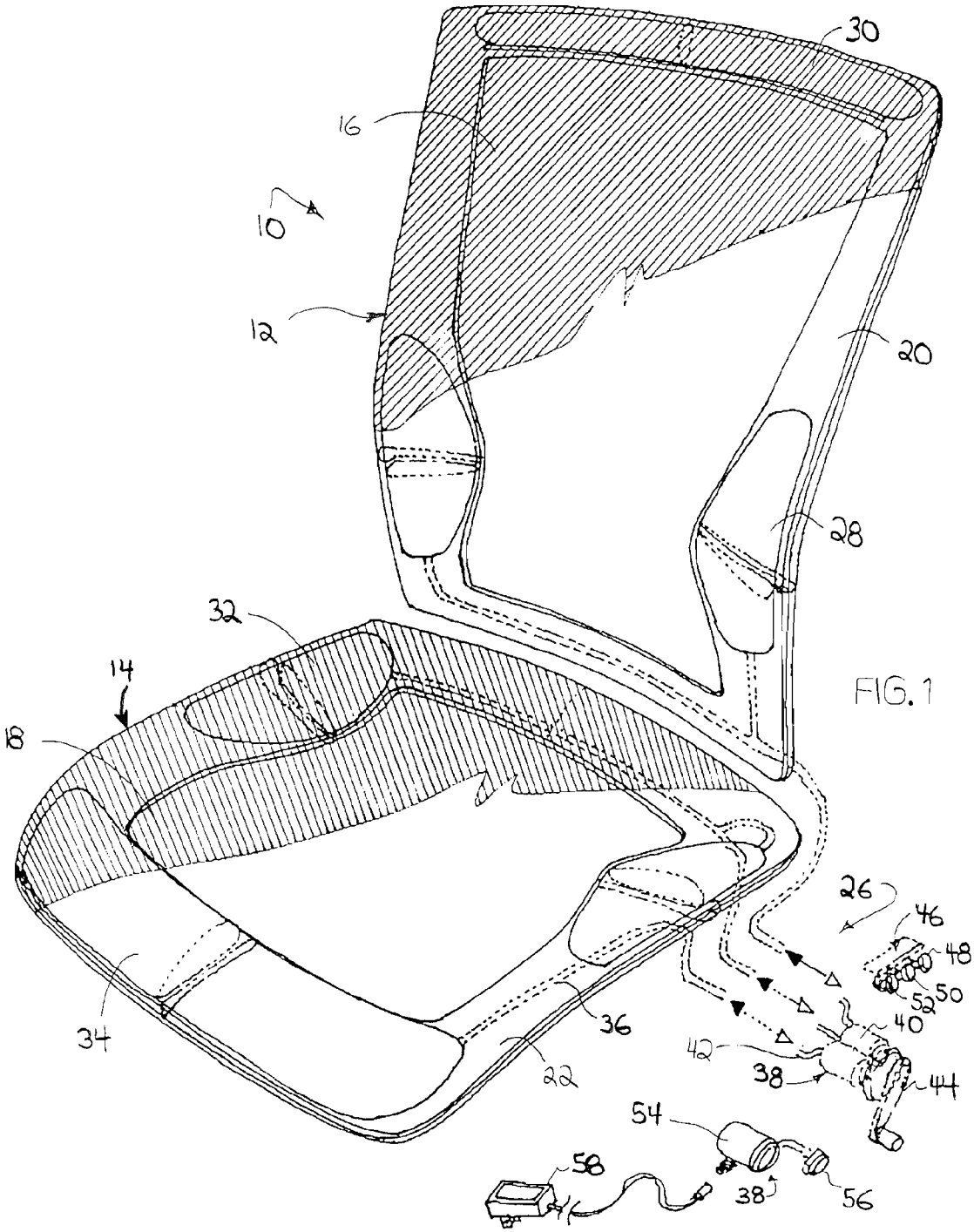
FIG. 1 is a perspective view of a post-assembly tension adjustment arrangement pursuant to the present invention employed in relation to an elastomeric material application.

One arrangement for enabling post-assembly tension adjustment in an elastomeric material application is shown in FIG. 1. There, a seat structure 10 has a seat back 12 and a seat bottom 14. The seat back 12 is founded on a seat back frame 20 with a peripheral framework and, in this example, an open inner portion. A panel 16 of elastomeric material is disposed over the seat back frame 20 whereby the panel 16 can provide support to a back of a seat occupant. The elastomeric material can, for example, comprise elastomeric mesh, continuous elastomeric material, or any other resilient material. The seat bottom 14 is founded on a seat bottom frame 22 with a peripheral framework and, in this example, an open inner portion. A panel 18 of elastomeric material is disposed over the seat bottom frame 22 for providing support to a seat occupant's legs and posterior.

A tension adjustment assembly 26 is incorporated into the seat structure 10. Tension adjustment assemblies 26 within the scope of the present invention can employ any effective mechanism for inducing a post-assembly adjustment of tension in elastomeric material applications. In the example of FIG. 1, a plurality of bladders are interposed between the frames 20 and 22 and the panels 16 and 18 of elastomeric material respectively. More particularly, an upper bladder 30 is interposed between an upper edge of the frame 20 and the panel 16 for enabling a tension adjustment of the elastomeric material adjacent to an occupant's neck and shoulders. First and second lumbar bladders 28 are oppositely disposed between the frame 20 and the panel 16 in the lumbar region of the seat back 12 for enabling a lumbar region tension adjustment. Similarly, opposed first and second posterior bladders 32 are interposed between the frame 22 and the panel 18 for enabling variable tensioning and support to an occupant's posterior, and a forward bladder 34 is disposed adjacent to a front of the seat bottom 14 for enabling a localized tension adjustment in the panel 18. Of course, fewer, additional, or differently placed bladders are possible and within the scope of the invention.

A mechanism can be provided for inflating, adjusting the effective thickness of, pivoting, moving, or for otherwise causing the bladders 28, 30, 32, and 34 to induce a deflection of the localized portion of the panel 18 or 16 of elastomeric material. In this example, the bladders 28, 30, 32, and 34 can be selectively and possibly independently inflated or deflated thereby to enable a selective deflection of the panels 16 and 18 of elastomeric material. As FIG. 1 shows, the inflation of the bladders 28, 30, 32, and 34 can be controlled through a conduit system 36 by a pressurized fluid source 38.

The pressurized fluid source 38 can be manually powered, such as by a hand crank 44, hand pump, or any other mechanism, for inducing a pressurization of a pressure tank 40 or otherwise driving air through the system. Pressurized air from the pressure tank 40 can be supplied to the conduit system 36 through individualized supply sources 42. The supply of air or any other selected fluid to the various bladders 28, 30, 32, and 34 can be individually controlled by a control arrangement 46. The control arrangement 46 can, for example, have first, second, and third supply control buttons 48, 50, and 52 for selectively inflating or deflating the bladders 28, 30, 32, and 34.

Alternatively or additionally, as FIG. 1 also shows, the pressurized fluid source 38 can be electrically powered, such as by battery, through a power supply cord 58, or another power source that provides power to a pump 38. The pump 38 can be controlled by a power button 56. The pump 54 can provide pressurized air to the conduit system 36 through the individualized supply sources 42.

Under the above-described arrangements, the bladders 28, 30, 32, and 34 can be selectively inflated or deflated to control a localized deflection of the panels 16 and 18 of elastomeric material. The localized deflection can thus enable post-assembly control and adjustment of the localized tension and support characteristics of the panels 16 and 18.

Figure 5:
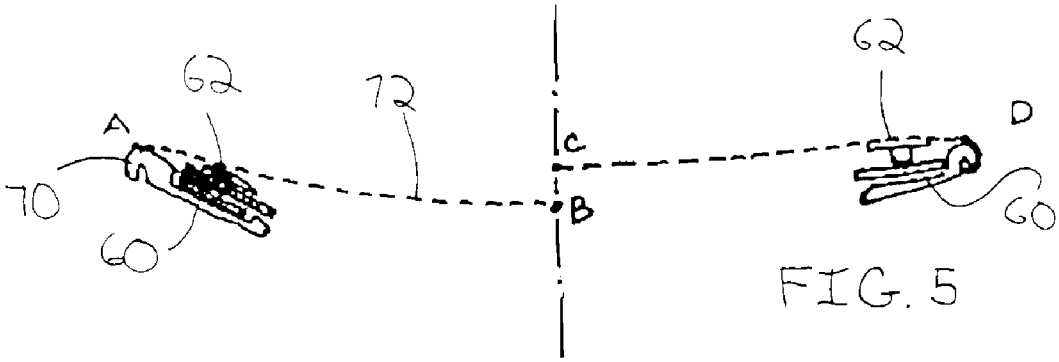
FIG. 5 is a lateral cross sectional view of a post-assembly tension adjustment arrangement pursuant to the instant invention in first and second dispositions in an elastomeric material application.

One alternative to fluidic tension control systems is shown in 2 through 6. There, localized, post-assembly tension adjustment in a panel 72 of elastomeric material that is retained relative to a framework 70 is accomplished by a mechanical extension and retraction arrangement 60. A deflection tip 62, which can be extendible and retractable by any effective means, can be employed to induce a deflection of the panel 72. In this embodiment, the deflection tip 62 can be extended and retracted by a threaded engagement between a support rod 66 and a housing 65 in combination with a disk 64 or other means for enabling a rotation of the support rod 66 in the relation to the housing 65. As FIG. 5 shows, the extension of the deflection tip 62 can deflect the panel 72 from disposition B to disposition C and, in doing so, adjust the tension and deflection characteristics of the panel 72 in response to, for example, an occupant of a seat or other applied force.

Figure 2:
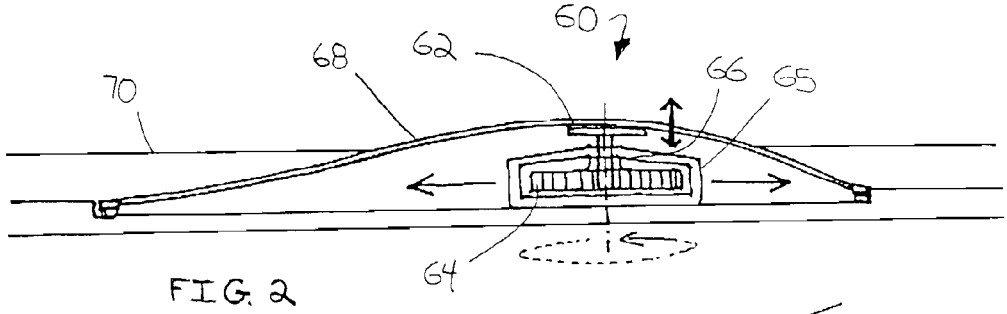
FIG. 2 is a sectioned view in side elevation of a mechanical extension and retraction arrangement for use in a post-assembly tension adjustment arrangement as taught herein.
Figure 3:
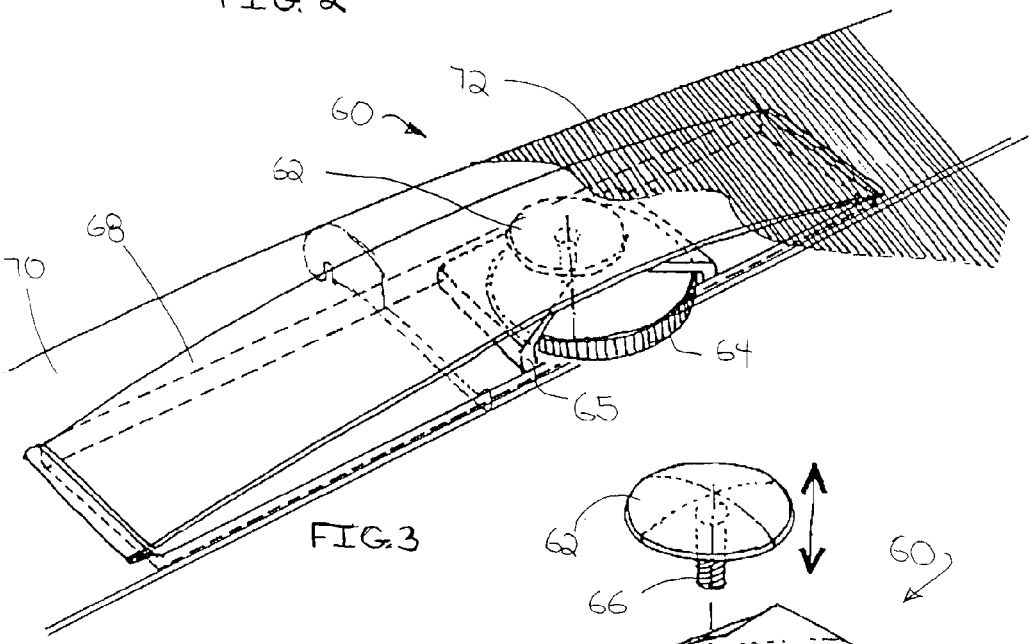
FIG. 3 is a partially sectioned perspective view of the mechanical extension and retraction arrangement of FIG. 2.
Figure 4:
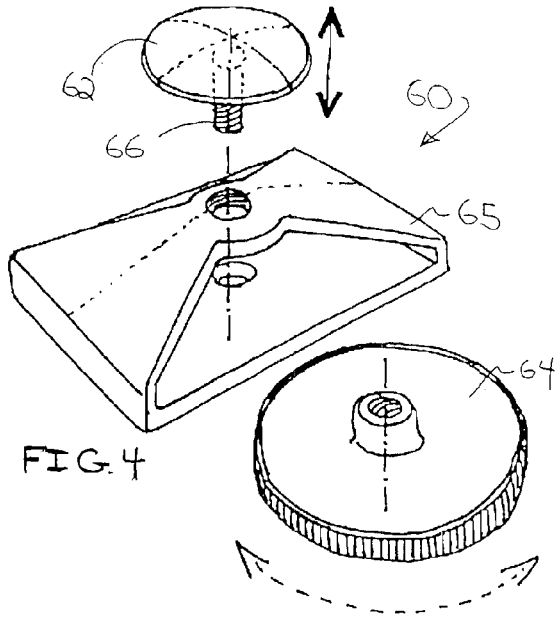
FIG. 4 is a perspective view of a portion of a mechanical extension and retraction arrangement under the instant invention.
Figure 6:
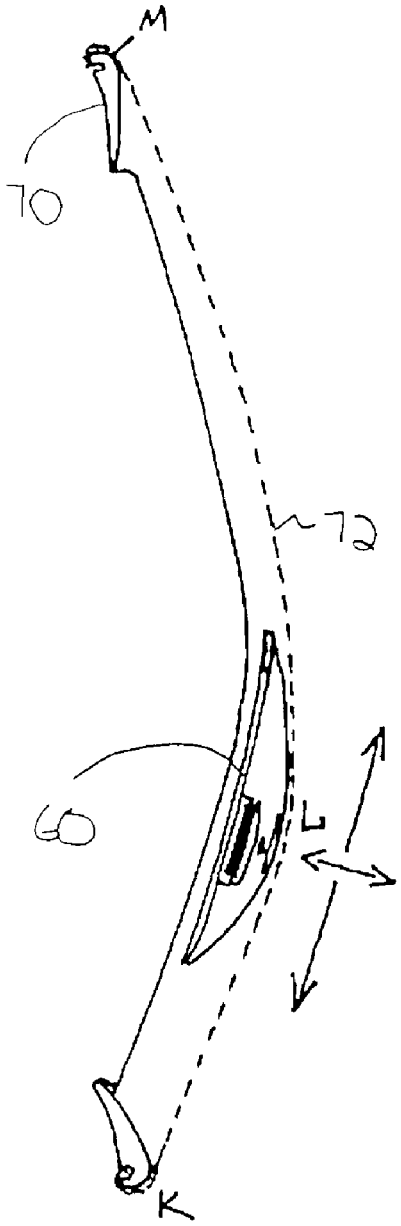
FIG. 6 is a vertical cross sectional view of a post-assembly tension adjustment arrangement pursuant to the instant invention in an elastomeric material application.

In certain embodiments, the housing 65, and thus the deflection tip 62, can be slidably retained relative to the framework 70 to enable an adjustment of the location of the localized deflection induced by the deflection tip 62 as depicted in FIG. 6. To facilitate the sliding of the housing 65, it can be slidably retained within a sheath 68 as shown in FIGS. 2 and 3.

Figure 7:
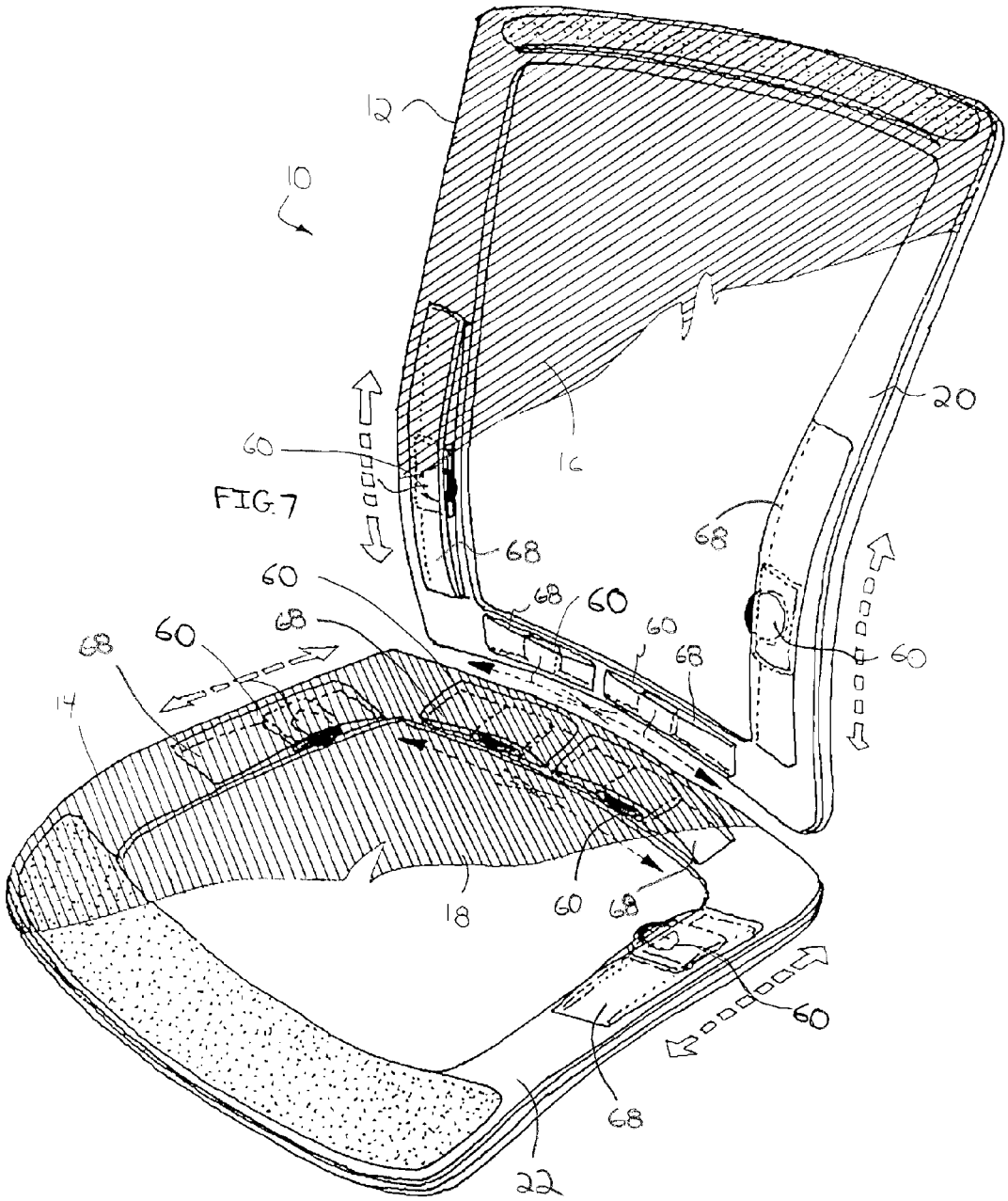
FIG. 7 is a perspective view of another post-assembly tension adjustment arrangement pursuant to the present invention employed in relation to an elastomeric material application.

In FIG. 7, a seat structure 10 is depicted that employs plural such extension and retraction arrangements 60 disposed in this example in the upper and lower lumbar regions of the seat back 12 and in the lateral and rearward portions of the seat bottom 14. As such, the tension in the panels 16 and 18 can be adjusted manually by an extension and retraction of the deflection tips 62 and a sliding of the extension and retraction arrangements 60 in relation to the sheaths 68 and, therefore, in relation to the frames 20 and 22.

Figures 8A, 8B:
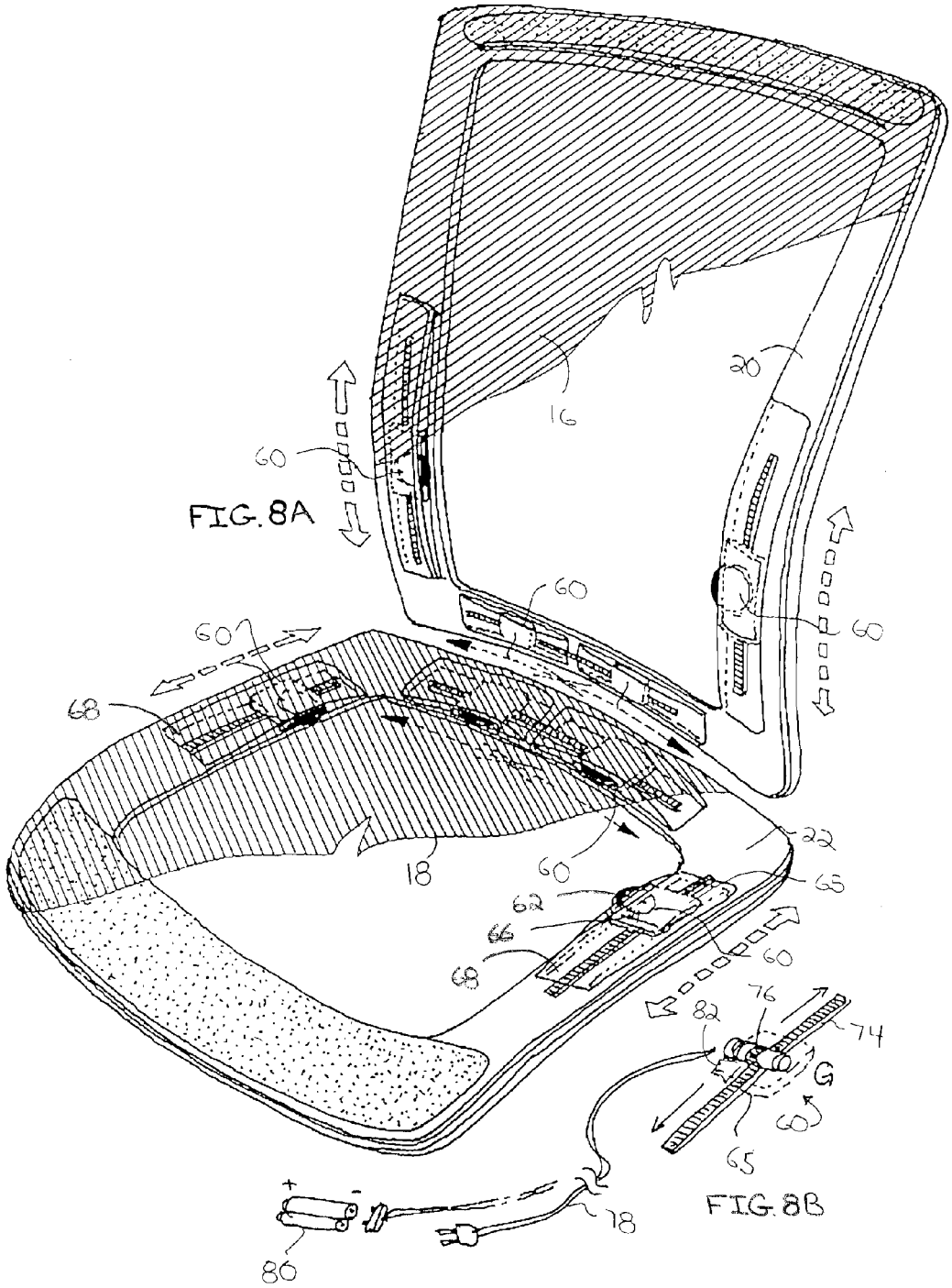
FIG. 8A is a perspective view of still another post-assembly tension adjustment arrangement pursuant to the present invention employed in relation to an elastomeric material application.
FIG. 8B is a perspective view of an alternative extension and retraction arrangement under the present invention.

Turning to FIGS. 8A and 8B, it can be seen that extension and retraction arrangements 60 pursuant to the present invention can alternatively be motorized such that extension and retraction and movement in relation to the frames 20 and 22 can be automated. Of course, numerous motorized mechanisms are possible. In this example, power is provided to a motor 82 by a battery source 80 and/or through a power cord 78 to enable a rotation of the rod 66 in relation to the housing 65 for extending and retracting the deflection tip 62 and to enable a travel of the extension and retraction arrangement 60 in relation to the sheath 68 and the respective frame 20 or 22 by a rotation of a pinion gear 76 in relation to a rack gear 74.

Figure 9:
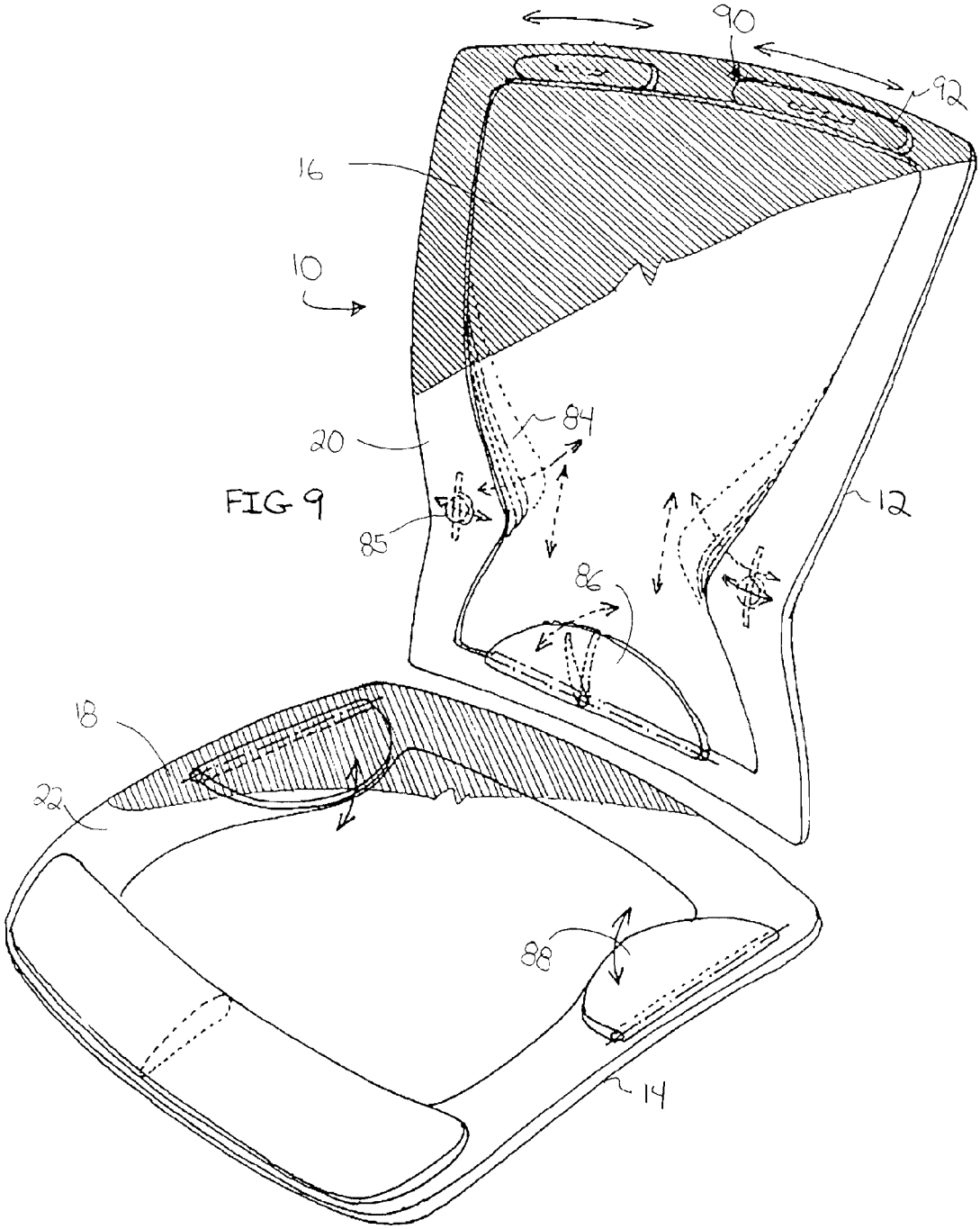
FIG. 9 is a perspective view of a further post-assembly tension adjustment arrangement pursuant to the present invention employed in relation to an elastomeric material application.
Figure 10:
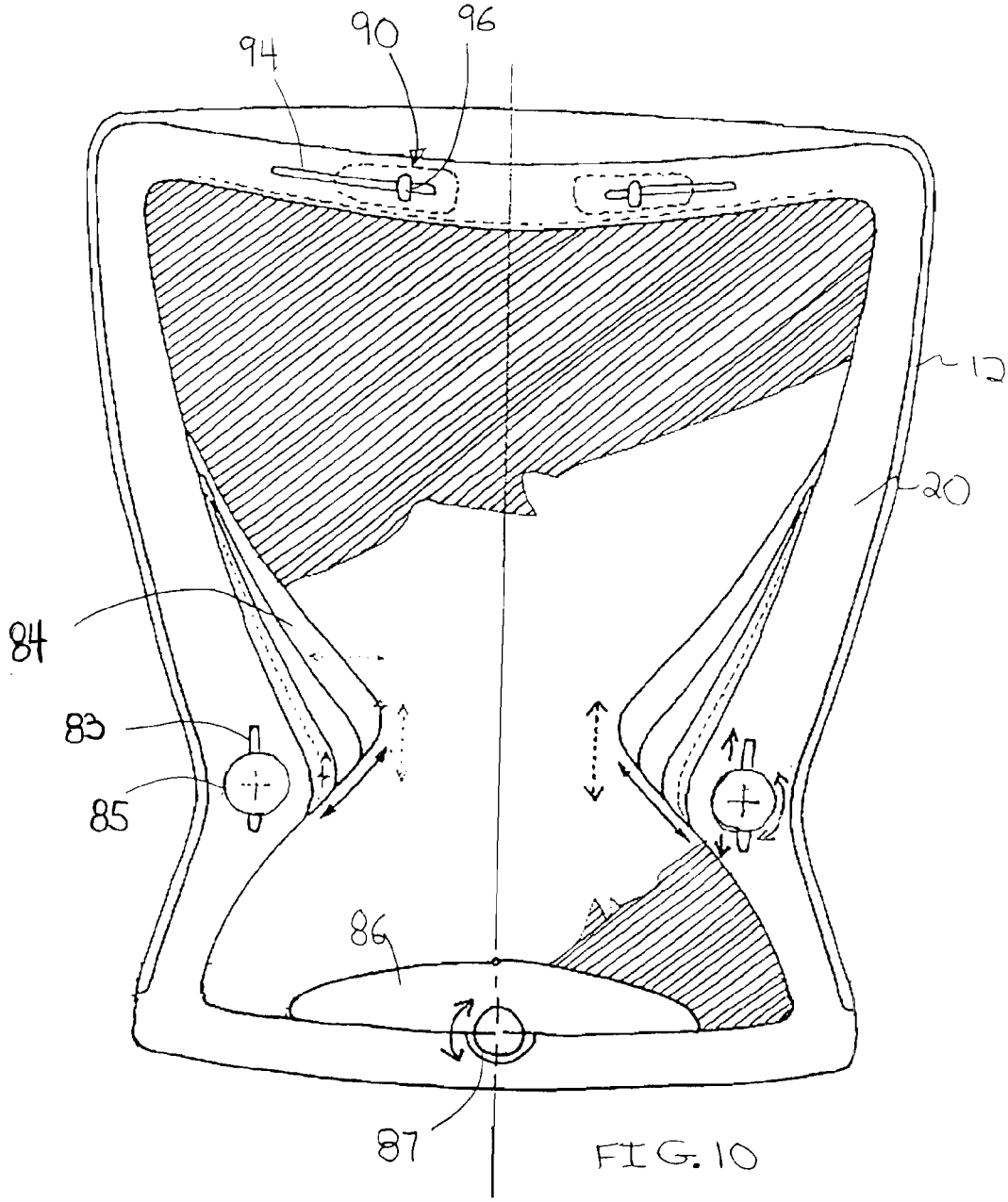
FIG. 10 is a partially sectioned view in rear elevation of an additional post-assembly tension adjustment arrangement pursuant to the present invention employed in relation to an elastomeric material application.
Figure 11:
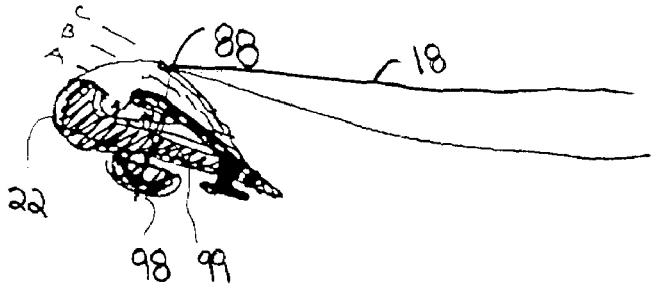
FIG. 11 is a cross-sectional view of yet another post-assembly tension adjustment arrangement pursuant to the invention employed in relation to an elastomeric material application.

In the embodiment of FIGS. 9 and 10, variable tensioning in the panels 16 and 18 of elastomeric material is accomplished by a variety of mechanisms for inducing a deflection of the panels 16 and 18. For example, post-assembly tension in the seat panel 18 can be controlled by a selective pivoting of pivotally retained paddles 88 oppositely retained relative to the sides of the seat frame 22. In FIG. 11, a paddle 88 can be pivoted by a support arm 99, which could comprise a threaded rod, with an adjusting knob 98 to enable dispositions in, for example, positions A, B, C, or anywhere in between. Similarly, lower lumbar tension in the back panel 16 can be adjusted by a selective pivoting of a pivotally retained paddle 86 retained at a bottom of the back frame 20.

Upper lumbar tension in the back panel 16 can be controlled by a fanning out of oppositely disposed pivoting panels 84. There can be singular or plural panels 84, and the movement of the same can be controlled by a control knob 85 that is slidable in a slot 83 in the back frame 20. Still further, tension in the upper portion of the panel 16 can be adjusted by a sliding of support pads 92 of a support arrangement 90. The location of the pads 92 can be controlled by knobs 96 slidable in slots 94. Contouring of the frame 20 and, additionally or alternatively, interposed wedges or shims (not shown) or other arrangements can yield an effective extension and retraction of the pads 92.

Figure 12:
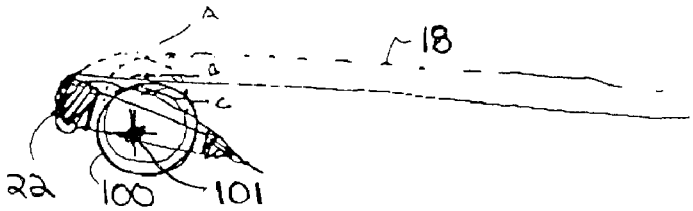
FIG. 12 is a cross-sectional view of a further post-assembly tension adjustment arrangement pursuant to the invention employed in relation to an elastomeric material application.
Figure 13:
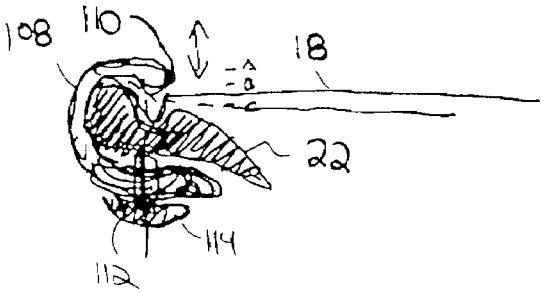
FIG. 13 is a cross-sectional view of still another post-assembly tension adjustment arrangement pursuant to the invention employed in relation to an elastomeric material application.
Figure 14:
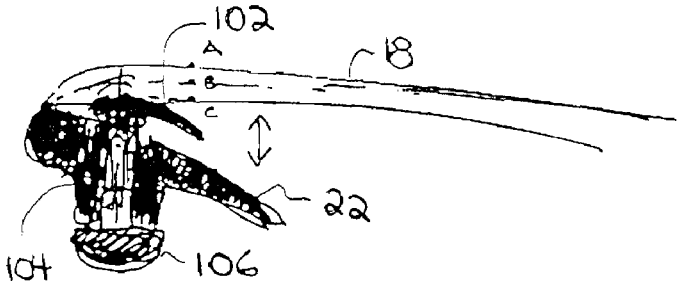
FIG. 14 is a cross-sectional view of another post-assembly tension adjustment arrangement pursuant to the invention employed in relation to an elastomeric material application.

In the manifestation of FIG. 12, tension in the panel 18 can be adjusted by one or more rollers 100 with a non-concentric pivot axis 101. With such a non-concentric pivot axis 101, the degree of deflection exacted by the roller 100 on the panel 18 can be adjusted by a selective rotation of the roller 100. In FIG. 13, an engaging tip 110 of a C-shaped deflection member 108 can selectively depress the edge of the panel 18 and, therefore, change the tension in the panel 18, based on a manipulation of a threadedly engaged rod 112 with a control knob 114. In the construction of FIG. 14, a contoured deflection tip 102 can be extended and retracted to deflect the panel 18 by use of a control knob 106 and support rod 104, which can be threaded.

Figure 15:
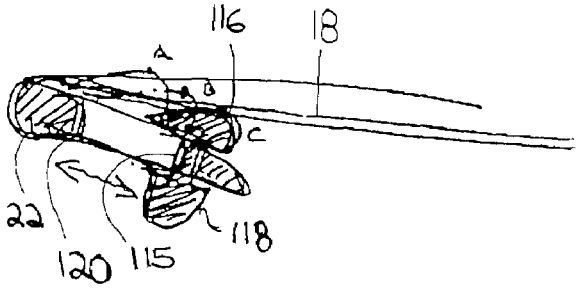
FIG. 15 is a cross-sectional view of an even further post-assembly tension adjustment arrangement pursuant to the invention employed in relation to an elastomeric material application.
Figure 16:
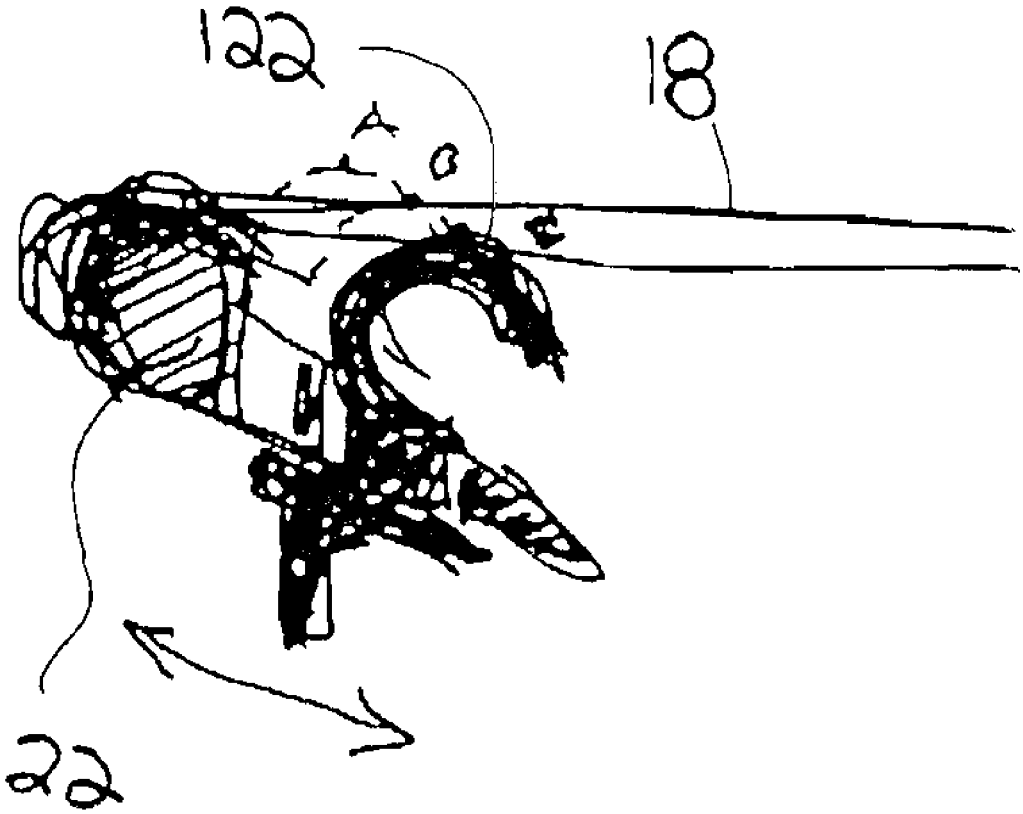
FIG. 16 is a cross-sectional view of an additional post-assembly tension adjustment arrangement pursuant to the invention employed in relation to an elastomeric material application.

Yet further, in FIG. 15, an embodiment is shown wherein a deflection member 116 can slide laterally in relation to a sloped portion of the frame 22 thereby to achieve a selective deflection and tensioning of the panel 18 of elastomeric material. The deflection member 116 can be retained relative to a rod 115 that is slidable in a slot 120 and controlled by a knob 118. Finally, as shown in the embodiment of FIG. 16, an arcuate member 122 can be slidably associated with the frame 22 to enable a selective deflection and tensioning of the panel 18. It will be noted that, although the panel 18 is indicated in the drawings, each of these embodiments can be used in relation to a seat back, a seat bottom, or any other furniture or other structure employing elastomeric material.

With certain details and embodiments of the present invention for arrangements for enabling post-assembly tension adjustment in elastomeric material applications disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof.

I claim as deserving the protection of Letters Patent:

1. An arrangement for enabling post-assembly tension adjustment in an elastomeric material application, the arrangement comprising:

a frame structure with first and second opposed sides;

a panel of elastomeric material with opposed first and second edges, a body portion between the first and second edges, an inner surface side, and an outer surface side;

means for retaining the first edge of the panel of elastomeric material in relation to the first side of the frame structure and means for retaining the second edge of the panel of elastomeric material in relation to the second side of the frame structure thereby to cause the panel of elastomeric material to span from the first side to the second side of the frame structure in tension; and a tension adjustment assembly operably associated with the frame structure and the panel of elastomeric material wherein the tension adjustment assembly comprises a means for selectively and adjustably pressing on the body portion of the panel of elastomeric material between the first and second edges of the elastomeric panel to induce a localized deflection of the panel of elastomeric material thereby to enable a selective post-assembly deflection and adjustment of tension in the panel of elastomeric material wherein the tension adjustment assembly comprises a slidable member coupled for lateral sliding relative to the frame structure, wherein the slidable member can be selectively slid to adjust a deflection of the panel of elastomeric material, and wherein the slidable member is disposed to the inner surface side of the panel of elastomeric material.

2. The arrangement of claim 1 wherein the frame structure is chosen from the group consisting of a seat back and a seat bottom.

3. The arrangement of claim 1 wherein the tension adjustment assembly further comprises an extension and retraction arrangement with a biasing portion for contacting the panel of elastomeric material and a means for selectively extending and retracting the biasing portion in relation to the panel of elastomeric material.

4. The arrangement of claim 3 wherein the means for selectively extending and retracting the biasing portion comprises an axially extendible and retractable rod.

5. The arrangement of claim 4 wherein the rod is threaded and further comprising a knob for enabling a rotation of the rod.

6. The arrangement of claim 3 wherein the biasing portion is disposed to the inner surface side of the panel of elastomeric material and wherein the biasing portion is moveable in relation to the frame structure thereby to enable an adjustment of a location of the biasing portion and the deflection and adjustment of tension imparted thereby.

7. The arrangement of claim 6 further comprising a sleeve interposed between the panel of elastomeric material and the frame structure, wherein the biasing portion is moveable within the sleeve.

8. The arrangement of claim 6 further comprising a motor and a drive arrangement for selectively extending and retracting the biasing portion and for selectively adjusting the location of the biasing portion in relation to the frame structure.

9. The arrangement of claim 1 wherein the tension adjustment assembly further comprises a pivoting member pivotally coupled to the frame structure wherein the pivoting member can be selectively pivoted to adjust a deflection of the panel of elastomeric material.

10. The arrangement of claim 9 further comprising an axially extendible and retractable rod operably associated with the pivoting member for adjusting a disposition of the pivoting member.

11. The arrangement of claim 1 wherein the panel of elastomeric material comprises a panel of elastomeric mesh.

12. An arrangement for enabling post-assembly tension adjustment in an elastomeric material application, the arrangement comprising:

a frame structure with first and second opposed sides;

a panel of elastomeric material with opposed first and second edges, a body portion between the first and second edges, an inner surface side, and an outer surface side;

means for retaining the first edge of the panel of elastomeric material in relation to the first side of the frame structure and means for retaining the second edge of the panel of elastomeric material in relation to the second side of the frame structure thereby to cause the panel of elastomeric material to span from the first side to the second side of the frame structure in tension; and a tension adjustment assembly operably associated with the frame structure and the panel of elastomeric material wherein the tension adjustment assembly comprises a means for selectively and adjustably pressing on the body portion of the panel of elastomeric material between the first and second edges of the elastomeric panel to induce a localized deflection of the panel of elastomeric material thereby to enable a selective post-assembly deflection and adjustment of tension in the panel of elastomeric material wherein the tension adjustment assembly comprises a roller with a non-concentric pivot axis whereby a deflection of the panel of elastomeric material can be adjusted by a selective rotation of the roller and wherein the roller is disposed to the inner surface side of the panel of elastomeric material.

13. The arrangement of claim 12 wherein the tension adjustment assembly further comprises a deflection member with a tip portion disposed to the outer surface side of the panel of elastomeric material wherein the deflection member is extendible and retractable whereby the tip portion of the deflection member can selectively depress the panel of elastomeric material.

14. The arrangement of claim 12 wherein the panel of elastomeric material comprises a panel of elastomeric mesh.

15. The arrangement of claim 12 wherein the frame structure is chosen from the group consisting of a seat back and a seat bottom.

16. An arrangement for enabling post-assembly tension adjustment in an elastomeric material application, the arrangement comprising:

a frame structure with first and second opposed sides;

a panel of elastomeric material with opposed first and second edges, a body portion between the first and second edges, an inner surface side, and an outer surface side;

means for retaining the first edge of the panel of elastomeric material in relation to the first side of the frame structure and means for retaining the second edge of the panel of elastomeric material in relation to the second side of the frame structure thereby to cause the panel of elastomeric material to span from the first side to the second side of the frame structure in tension; and a tension adjustment assembly operably associated with the frame structure and the panel of elastomeric material wherein the tension adjustment assembly comprises a means for selectively and adjustably pressing on the body portion of the panel of elastomeric material between the first and second edges of the elastomeric panel to induce a localized deflection of the panel of elastomeric material thereby to enable a selective post-assembly deflection and adjustment of tension in the panel of elastomeric material wherein the tension adjustment assembly comprises a deflection member wherein the deflection member is slidable on an inclined surface in relation to the panel of elastomeric material whereby the deflection member can selectively deflect the panel of elastomeric material by a relative sliding of the deflection member.

17. The arrangement of claim 16 wherein the tension adjustment assembly further comprises a bladder in combination with a means for selectively inflating and deflating the bladder.

18. The arrangement of claim 17 wherein the bladder is disposed to the inner surface side of the panel of elastomeric material and the frame structure.

19. The arrangement of claim 18 wherein there are plural bladders.

20. The arrangement of claim 19 further comprising a means for independently and selectively inflating and deflating the plural bladders.

21. The arrangement of claim 17 wherein the frame structure comprises a peripheral frame with an open inner portion.

22. The arrangement of claim 16 wherein the panel of elastomeric material comprises a panel of elastomeric mesh.

23. The arrangement of claim 16 wherein the frame structure is chosen from the group consisting of a seat back and a seat bottom.

* * * * *